US007314100B2

(12) United States Patent
Roggeband

(10) Patent No.: US 7,314,100 B2
(45) Date of Patent: Jan. 1, 2008

(54) SYSTEM FOR USE IN A BORE HOLE FOR AXIALLY COUPLING A TUBULAR END AND A MANDREL

(75) Inventor: Serge Mathieu Roggeband, Rijswijk (NL)

(73) Assignee: Shell Oil Company, Houston, TX (US)

( * ) Notice: Subject to any disclaimer, the term of this patent is extended or adjusted under 35 U.S.C. 154(b) by 253 days.

(21) Appl. No.: 10/538,462

(22) PCT Filed: Dec. 12, 2003

(86) PCT No.: PCT/EP03/50991

§ 371 (c)(1),
(2), (4) Date: Jun. 10, 2005

(87) PCT Pub. No.: WO2004/053286

PCT Pub. Date: Jun. 24, 2004

(65) Prior Publication Data

US 2006/0118337 A1 Jun. 8, 2006

(30) Foreign Application Priority Data

Dec. 12, 2002 (EP) ..... 02080230
Feb. 24, 2003 (EP) ..... 03075523
Mar. 11, 2003 (EP) ..... 03075712

(51) Int. Cl.
*E21B 4/02* (2006.01)
*F16C 19/02* (2006.01)

(52) U.S. Cl. ..... 175/107; 384/613; 384/126

(58) Field of Classification Search ..... 175/107; 384/126, 613
See application file for complete search history.

(56) References Cited

U.S. PATENT DOCUMENTS

| | | | | |
|---|---|---|---|---|
| 46,478 | A | 2/1865 | Lauback | |
| 3,666,440 | A | 5/1972 | Kono et al. | 75/76 |
| 4,729,675 | A | 3/1988 | Trzeciak et al. | 384/613 |
| 5,074,681 | A | 12/1991 | Turner et al. | 384/613 |
| 6,202,762 | B1 * | 3/2001 | Fehr et al. | 175/107 |
| 2006/0110083 | A1 | 5/2006 | Roggeband | 384/92 |

OTHER PUBLICATIONS

International Search Report dated Jun. 4, 2004.

* cited by examiner

*Primary Examiner*—William P Neuder

(57) ABSTRACT

System for coupling two tubular ends for use in a well bore, the system comprising a first tubular end, a second tubular end for inserting into the first tubular end in axial alignment thereof, thereby forming an annular space between the first tubular end and the second tubular end, and a connecting assembly for axially coupling the first tubular end with the second tubular end whereby the connecting assembly at least partly reaches in the annular space.

28 Claims, 3 Drawing Sheets

SYSTEM FOR USE IN A BORE HOLE FOR AXIALLY COUPLING A TUBULAR END AND A MANDREL

PRIORITY CLAIM

Figure 1:
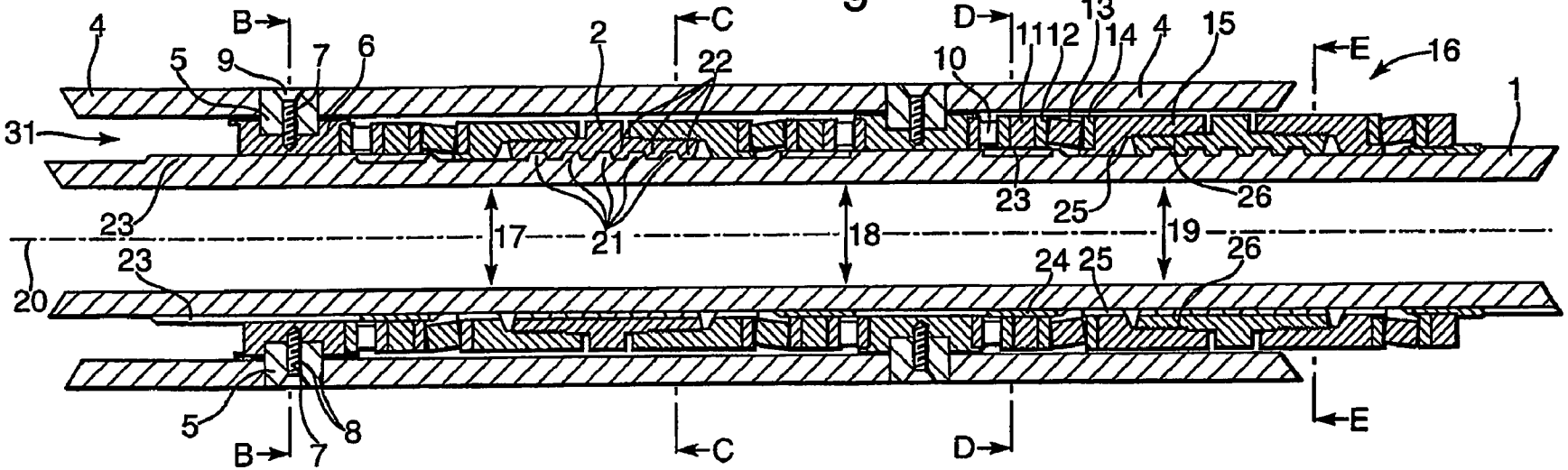

The present application claims priority on European Patent Application 02080230.2 filed 12 Dec. 2002; European Patent Application 03075523.5 filed 24 Feb. 2003 AND European Patent Application 03075712.4 filed 11 Mar. 2003.

FIELD OF THE INVENTION

The present invention relates to a system for use in a bore hole, such as a well bore, for axially coupling a tubular end with a mandrel. In particular the tubular end can be a first tubular end and the mandrel a second tubular end.

The invention further relates to a connecting assembly for such a system.

BACKGROUND OF THE INVENTION

In oil well drilling and completion operations, drill strings are used. These drill strings often comprise various types and sized of tubular components like drill pipes, drill collars, liner, casing, and tubing in various configurations. In coupling such tubular ends, sometimes functionality is required, such as rotatablity of one end with respect to an adjacent end.

In U.S. Pat. No. 5,074,681 a thrust bearing assembly is described in the form of a spring assembly reaching in an annular space between a housing tube end and a drive shaft. The spring assembly is provided with bearing means whereby first race members are secured within the housing tube end. The second race members transmit the load to axially spaced apart spacer rings which are rotatable with the drive shaft and are kept in their spaced apart positions by a series of sleeve members. The load is axially transmitted through the series of spacer rings and sleeve members. The last spacer ring is axially supported by the drive shaft by means of a shoulder, so that an axial load can be transmitted from the drive shaft to the series of spacer rings and sleeve members.

It is an object of the invention to provide an improved system for coupling two tubular ends for use in a bore hole, such as a well bore.

In accordance with the invention, there is provided a system for use in a bore hole, such as a well bore, for axially coupling a tubular end with a mandrel, the system comprising a tubular end, a mandrel for inserting into the tubular end in axial alignment thereof, thereby forming an annular space between the tubular end and the mandrel, and a connecting assembly that at least partly reaches in the annular space and that comprises two or more transmission units each being arranged for axially coupling the tubular end with the mandrel, wherein the transmission units each comprise a first fixture element, a second fixture element, and spacer means for maintaining an axial displacement between the first fixture element and the second fixture element, whereby the first fixture element is axially connectable to an inner surface of the tubular end and the second fixture element is axially connectable with the mandrel.

Each transmission unit itself is arranged for axially coupling the tubular end with the mandrel. This has the advantage that the full load is divided over two or more coupling points on the tubular end and the mandrel. At the same time, these transmission units may either act individually or in concert with other transmission units. Thus both coupling and the other functionality can be independently optimised and mounted.

By providing the spacer means additional to the fixture elements, the coupling functionality is separated from other functionality attributable in the connecting assembly.

The provision of a separate connecting assembly between the tubular ends, allows for adding additional functionality to the system. This functionality can conveniently be provided by a selection of a customized connecting assembly, and therefore the system is easily adaptable to custom need. Due to its at least partial reach into the annular space, the connecting assembly is protected from the outside by the tubular ends themselves that are connected by the connecting assembly.

The two or more transmission units may be interconnected so as to form a string of interconnected transmission units.

For instance, the connecting assembly, and in particular the spacer means, may be provided with one or more of the following features.

The spacer means may comprise adjustment means for adjusting the axial displacement. Herewith it is achieved that the fixture elements can for instance be coupled to their respective tubular ends at an approximated position and the axial displacement can subsequently be altered in a more controlled way without having to uncouple one or both of the fixture elements. In an embodiment, the adjustment means comprises a thread connection defining a thread path essentially coaxial to the mandrel.

In an embodiment of the invention, the spacer means comprises a bearing element cooperating with a bearing race supporting the bearing element in a plane perpendicular to the alignment axis, whereby the first fixture element is rotatable with respect to the second fixture element about the alignment axis.

In an embodiment, the spacer means comprises resilient means for providing axial resilience to the tubular ends when coupled. Also, the resilient means help to distribute the axial load proportionally over each available transmission unit.

Preferably, the resilient means in at least one of the transmission units has a lower stiffness than the resilient means in another one of the transmission units. By varying the stiffness of the various transmission units, the distribution of the load over the transmission units can be influenced. A lower stiffness leads to a lower portion of the load being transmitted via that transmission unit.

In an embodiment, the system further comprises first locking means for establishing a releasable axial coupling between the first fixture element and an inner surface of the tubular end. Herewith it is achieved that the tubular end can be conveniently released and slided from the connecting assembly so that the connecting assembly becomes exposed, for instance for maintenance. Or, during assembly, the mandrel with the connecting assembly already mounted on it, can be inserted into the tubular end and a releasable axial coupling between the first fixture element and the inner surface of the tubular end can then be established.

The first locking means may for instance comprise an opening provided through a sidewall of the tubular end, a receiving opening in the first fixture element, and an insertable locking member for extending through the opening and reaching in the receiving opening when in axially locked condition. This is locked by bringing the receiving opening in the first fixture element into alignment with the opening in the sidewall of the tubular end and inserting the insertable locking member.

In an embodiment, the system further comprises second locking means for axially releasably locking the second fixture element on an outer surface of the mandrel. This locking means may for instance be controllably lockable and releasable by a relative rotation of the second fixture element the mandrel about the alignment axis.

Preferably, the second fixture element is shaped to embrace the locking portion of the mandrel over essentially its full circumference. Herewith an even distribution of the axial force between the tubular end and the mandrel over the locking portion is achieved. Also, this geometry is advantageous for centring other features of the connecting assembly around the mandrel.

In an embodiment, the second locking means comprises at least one couple of cooperating locking rim segments, one locking rim segment of which couple being provided on the locking portion of the mandrel and one locking rim segment of which couple being provided on the second fixture element. By bringing the couple of cooperating locking rim segments in axial alignment, the second fixture element is locked to the mandrel such as to transfer axial force from one to the other. By relative rotation around the alignment axis, the segments can be brought to axial misalignment, in which position the second fixture element is no longer locked. Herewith the second fixture element is quickly mountable to and/or dismountable from the mandrel.

Means may be provided to secure the second fixture element and the mandrel in alignment to prevent them from inadvertently coming in axial misalignment.

In addition to the couple of cooperating locking rim segments, an additional locking rim segment can be provided on either the tubular element or the mandrel, such that the locking rim segment on one tubular end is sandwiched between the cooperating locking rim segment and the additional locking rim segment on the other tubular end.

BRIEF DESCRIPTION OF THE INVENTION

Figure 2:
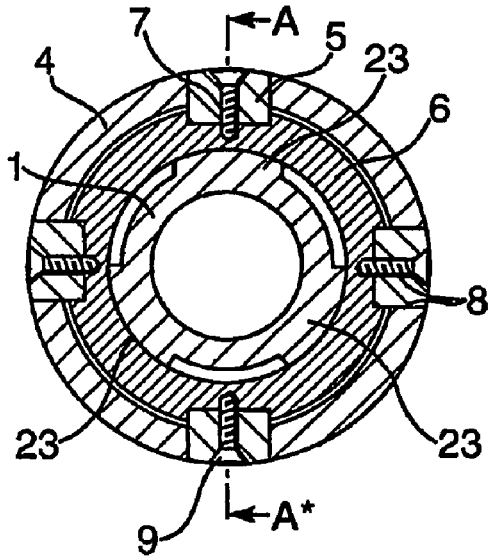
Figure 3:
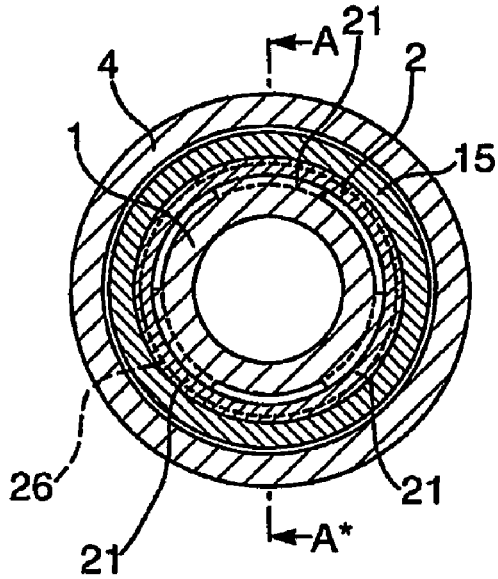
Figure 4:
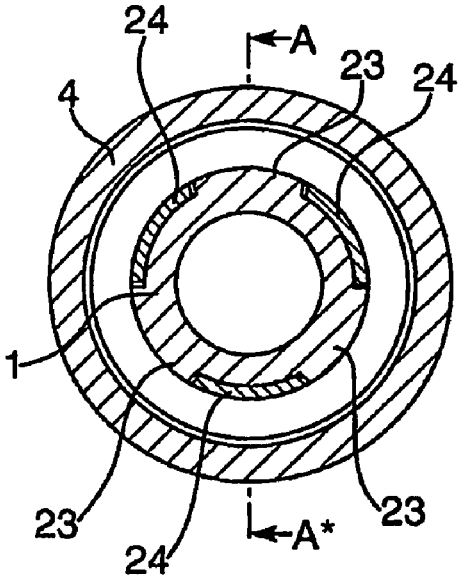
Figure 5:
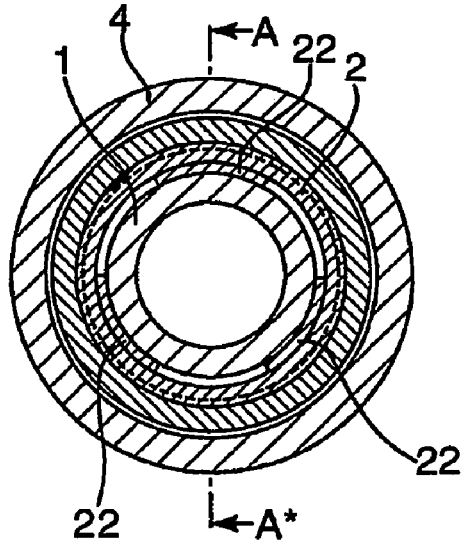
Figure 6:
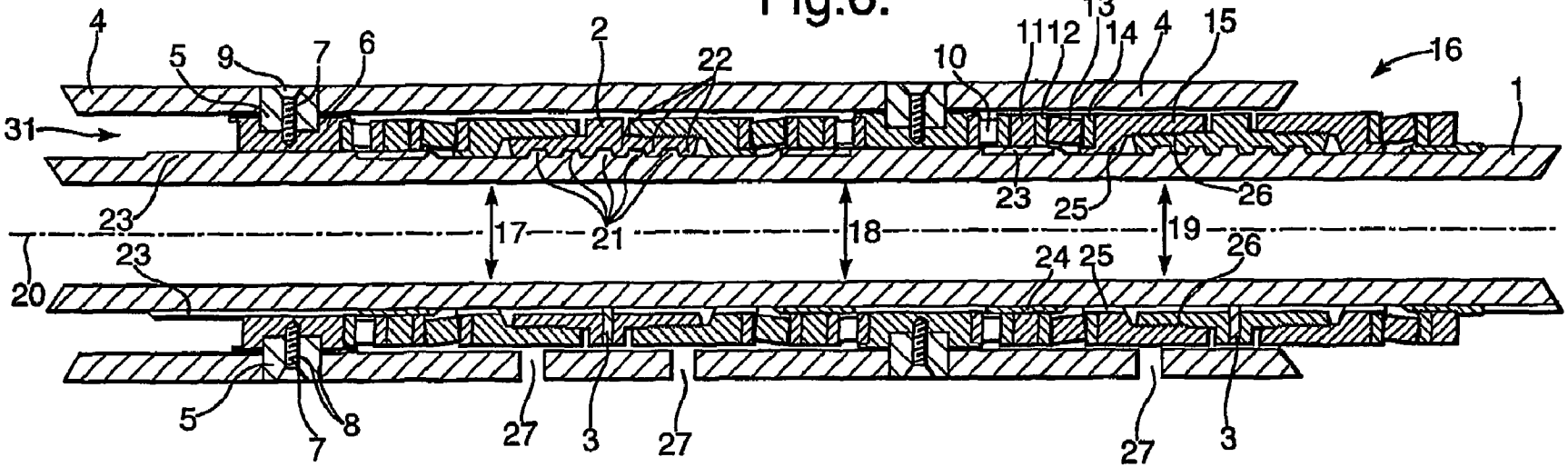

The invention will described hereinafter in more detail and by way of example, with reference to the accompanying drawings in which:

FIG. 1 schematically shows a longitudinal section along line A-A* of an embodiment of the system according to the invention;

FIG. 2 schematically shows a cross sectional view of system of FIG. 1 along line B-B;

FIG. 3 schematically shows a cross sectional view of system of FIG. 1 along line C-C;

FIG. 4 schematically shows a cross sectional view of system of FIG. 1 along line D-D;

FIG. 5 schematically shows a cross sectional view of system of FIG. 1 along line E-E; and FIG. 6 schematically shows a longitudinal sectional view of another embodiment of the system according to the invention.

In the Figures like reference signs relate to like components.

DETAILED DESCRIPTION OF THE PREFERRED EMBODIMENT

Referring to FIG. 1 there is schematically shown a longitudinal section of one embodiment of the system for coupling a tubular end 4 and a mandrel 1, in axial alignment for use in a well bore. In this example, the tubular end 4 corresponds to a first tubular end, and the mandrel 1 is provided in the form of a second tubular end.

The first and second circular tubular ends are rotatably coupled, whereby the second tubular end 1 is inserted into the first tubular end 4. The second tubular end 1 acts as mandrel 1, whereas the first tubular end 4 is shown in the form of housing 4. The tubular ends 1,4 are in axial alignment of each other, extending around alignment axis 20.

An annular space 31 is formed between the axis 1 and the housing 4. A connecting assembly 16 reaches into the annular space 31. The connecting assembly is shown in the form of three transmission units 17,18,19 that are interconnected so as to form a string of interconnected transmission units. It is not essential to the invention to have three transmission units, a different number of transmission units may be preferred. Each transmission unit is in itself arranged for axially coupling the first tubular end with the second tubular end. Mandrel 1 has a bore along axis 20, but it may also be a solid mandrel member.

Still referring to the embodiment of FIG. 1, each transmission unit 17,18,19 in the connecting assembly 16 contains identical parts. In other embodiments, however, the various transmission units may be composed of different parts.

The transmission units are provided with a first fixture element in the form of housing fitting 6 and a second fixture element in the form of fixture nut 2. Neighbouring transmission units are interconnected via the respective fixture elements, for instance, transmission unit 17 is interconnected with transmission unit 18 via the fixture nut 2, and transmission unit 19 is interconnected with transmission unit 18 via the housing fitting.

The housing 4 is provided with a number of holes in its side wall, with a tolerance diameter in the circumference. FIG. 1 shows insertable locking members in the form of pins 5 that are placed in the holes and reach in and are retained by receiving openings provided in the housing fittings 6. The pins 5 may be fixed by a screw 7 or the like, preferably having a tapered head 9.

There are seals 8 between the housing 4 and the pin 5 and between the pin 5 and the screw 7. Herewith a pressure tight separation between the annulus 31 of the assembly and the exterior of the housing 4 is achieved.

A cross section along line B-B is schematically depicted in FIG. 2, showing the housing 4, the housing fitting 6, and the axis 1, the housing 4 being provided with four holes in the circumference through which holes the pins 5 extend and reach into receiving openings in the housing fitting 6. The screws 7 having the tapered heads 9 are shown to fix pins 5 to the housing fitting 6.

FIG. 1 further shows a locking portion on the mandrel L 1 which locking portion has a circular circumference, and is provided with locking rim segments 21. Five locking rim segments 21 are shown, but any suitable number depending on strength considerations may suffice. The fixture nut 2 is shaped to embrace the locking portion. The fixture nut 2 is also provided with a number of locking rim segments 22. The number of locking rim segments, in the present embodiment six, is in accordance with the number of locking rim segments 22 on fixture nut 2. Preferably the axial faces of the locking rim segments 22 on the fixture nut 2 are essentially in a plane perpendicular to center line 20 such that they do essentially not function as thread windings.

Cross sections along lines C-C and E-E in the locking portions of the assembly are schematically depicted in FIG.

3 and FIG. 5, respectively, showing the housing 4, the fixture nut 2, and the mandrel 1. FIG. 3 shows the locking rim segments 21 external on mandrel 1, while FIG. 5 shows the locking rim segments 22 provided inwardly in the fixture nut 2. As can be seen, three locking rim segments 22 are provided evenly distributed over the circumference. A different number of locking rim segments is also possible. The total fraction of the circumference that is occupied by the locking rim segments should preferably be at most approximately 50%.

For instance, by having approximately only half or less of the total circumference covered by the locking rim segments 22, the fixture nut 2 can also have approximately half or less of the total circumference covered by its locking rim segments 22 for optimally spreading the axial load. At the same time the fixture nut 2 be conveniently installed by first shifting it axially through the open slots to the locking portion on the mandrel 1, and then, by applying a rotation of the fixing nut 2 relative to the mandrel 1, engaging the external rim segments 21 on the mandrel 1 and the internal rim segments 22 in the nut. Preferably, a securing device, such as a bolt, may be applied such that any relative rotation between the mandrel 1 and the fixture nut 2 is prevented and the locking rim segments 21,22 remain engaged for axial load transfer.

It will be understood that the remainder of the axis between its end and the locking portion should preferably either have a sufficiently small external diameter, or sufficiently large segments wherein the external diameter is sufficiently small to enable the shifting of the fixture nut 2 to the locking portion. In FIG. 2, for instance, can be seen spline segments 23, which spline segments 23 have a larger external diameter than the majority of the mandrel 1, and the orientation of which on the mandrel 1 axially corresponds to that of the locking rim segments 21.

The housing fitting 6 and the fixture nut 2 are coupled to each other with spacer means S, which in the embodiment of FIG. 1 comprises the following components as described herebelow. The spacer means S serves to couple the housing fitting 6 to the fixture nut 2, and to maintain an axial displacement between the housing fitting 6 and the fixture nut 2.

Referring again to FIG. 1, the spacer means S in transmission unit 19, which is essentially identical to the ones in transmission units 17 and 18, is provided with bearings 10. Bearings 10 cooperate with a bearing race 28 supporting the bearing element in a plane perpendicular to the alignment axis 20. As a result, the housing fitting 6 is rotatable about the alignment axis with respect to the fixing nut 2. When the system is coupled, the tubular ends are consequently rotatable with respect to each other.

The bearings 10 can be of any suitable type, including roller bearing, ball bearing, spherical roller bearing, tapered roller bearing.

The bearings 10 are mounted in between the housing fitting 6 and a sliding ring 11. On the mandrel 1 the earlier mentioned spline profile 23 has been provided at the position underneath the sliding ring 11, for instance by machining. A corresponding opposite profile 24 has been provided on the inner of the sliding ring 11, for instance by machining. This is best shown in FIG. 4 in the cross section along line D-D. The siding ring 11 is therefore able to freely slide along the mandrel 1, whereby the interlocking spline profiles 23,24 prevent any relative rotation.

Also provided is resilient means in the form of a spring 13, in particular a disc spring. Spring 13 is preferably mounted in between two support members in the form spring support rings 12,14. Preferably the spring support rings are hardened for they may suffer from wear caused by strained movement of the spring 13.

As can be seen in FIG. 1, the sliding rings 11 extend underneath the bearings 10 on one side, and underneath the spring support ring 12 and spring 13 on its other side, such that these are centred on the mandrel 1.

The spring 13 and spring support ring 14 is supported by adjustment means for adjusting the axial displacement between the housing fitting 6 and the fixture nut 2. Generally, the spacer means is preferably threadably adjustable by means of adjustment means in the form of a thread connection. The adjustment means is here presented in the form of an adjustment nut 15. The adjustment nut 15 serves to reduce play and to accurately position the bearings 10.

The adjustment nut 15 has an internal spline profile 25, which allows it to be slid though the previously mentioned various splines and rim segments present along the axis during installation and/or mounting. At the position underneath adjustment nut 15 the mandrel 1 is spline free. The adjustment nut 15 is connected to the fixture nut 2 via a threaded profile 26 that essentially defines a threaded path that is coaxial to the axis 1.

The threaded profile 26 may be as fine as is needed for obtaining sufficient adjustment accuracy. The treaded profile 26 is understood to include fixture nut thread on the fixture nut 2 and a cooperating adjustment nut thread on the adjustment nut 15 acting as the spacer means thread.

The cross section depicted in FIG. 3 also shows the adjustment nut 15 adjustably engaged via the thread 26 with the fixture nut 2.

Because of the above described design, the adjustment nut 15 can be rotated about the alignment axis 20 and relative to the fixture nut 2 and, when the fixture nut is in locked position, relative to mandrel 1. This rotation will be accompanied by an axial displacement of the adjustment nut 15 relative to the fixture nut 2, due to the lead of the threaded connection between the adjustment nut 15 and the fixture nut 2.

FIG. 6 shows an embodiment of the invention, showing in addition to the features described above a securing device 3 provided in fixture nut 2, and/or an adjustment opening 27 provided in housing 4.

Securing device 3, suitably a bolt, is provided such that any relative rotation between the mandrel 1 and the fixture nut 2 is prevented and the locking rim segments 21,22 remain engaged for axial load transfer. Adjustment opening 27 is provided in the housing 4 to allow adjustment of adjustment nuts 15 with the housing 4 in position. If desired, pretension in spring 13 can be adjusted this way.

It is remarked that the individual parts in the above described embodiments are advantageously designed such that they are readily machinable and mountable in an industrially applicable manner.

For play-free assembly of the connecting assembly 16 onto mandrel 1, an additional assembly tool may be applied that is temporarily placed over the connecting assembly when the housing 4 is not yet in place. This is particularly useful in the case that the connecting assembly comprises bearings. The assembly tool (not shown) may have two strips with pins that have the same diameter as the openings provided in housing 4. The positions of the pins on the strips of the assembly tool have been calibrated and fixed to the positions of the openings in the housing 4. After the calibration of the assembly tool pin positions, all internal parts of the connecting assembly are mounted on the mandrel 1. Hereby, the fixture nuts 2 have already been locked to the mandrel 1. All other parts are still loose in axial direction. Then the assembly tool is mounted along mandrel 1, via a clamping ring. In addition, the pins on the assembly tool strips are temporarily fixed to the housing fittings 6.

The relative positions of the housing fittings 6 along the connecting assembly have now been fixed. By adjusting the adjustment nuts 15 the bearings 10 can be fixed at the correct axial positions and without any axial play.

After removal of the assembly tool, the housing 4 can be installed over the connecting assembly and the pins 5 can be inserted with no problem.

The above described embodiments allow for a reliable transfer of axial force from the mandrel 1 to the housing 4. The bearings can be centred, and the embodiment allows for a bearing suspension plane that is perpendicular to the alignment axis of the housing 4 and the axis 2. Moreover, the bearings are mountable on the axis 2 without axial play or each having the same axial play.

When provided with the resilient means 13 in a string of transmission units each having bearing means, the axial load is distributed over the individual transmission units, so that individual bearings can pick up load simultaneously. If the bearings in one of the transmission units picks up a relatively too large portion of the axial load, then the resilient means 13 in that transmission unit should be replaced by a less stiff resilient means to mitigate a portion of the load to the remaining transmission units. In that case the resilient means in at least one of the transmission units has a lower stiffness than the resilient means in another one of the transmission units. Unpublished European patent application 03075523, which serves as a priority application for the present application and is herewith incorporated by reference, provides a definition of stiffness and describes in detail how the stiffness of the transmission units can accurately be selected to achieve an essentially proportional distribution of the load over the transmission units.

The connecting assembly in the embodiment of the system described above provides combined functionality by means of an adjustable spacer means, a bearing element, resilient means, and other mentioned parts. Although the embodiment is preferred, the scope of the invention is not limited to a connecting assembly and a system wherein the functionality is combined in the described way. Embodiments only showing spacer means, which may be an adjustable spacer means, or resilient means, or means for providing rotatablity, in particular bearing means, or any other means for a preferred functionality, or any combination of these features, may be advantageously applicable in operations.

The invention has been disclosed here above as a system for coupling two tubular ends for use in a bore hole. The invention can also be advantageously applied for coupling, in particular rotateably coupling, two tubular ends for other uses and/or coupling a mandrel in the form of a solid axis to a tubular end. Also, the tubular end and the mandrel may have a non-circular cross section.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

The invention claimed is:

1. A system for axially coupling a tubular end with a mandrel, the system comprising a tubular end, a mandrel inserted into the tubular end, the mandrel in axial alignment with the tubular end thereby forming an annular space between the tubular end and the mandrel, and a connecting assembly in the annular space, the connecting assembly comprises two or more transmission units, each transmission unit in itself axially coupling the tubular end with the mandrel, wherein each transmission unit comprises a first fixture element, a second fixture element, and spacer means for maintaining an axial displacement between the first fixture element and the second fixture element, whereby the first fixture element is axially connectable to an inner surface of the tubular end and the second fixture element is axially connectable with the mandrel.

2. The system according to claim 1, wherein the two or more transmission units are interconnected to form a string of interconnected transmission units.

3. The system according to claim 1, wherein the spacer means comprises adjustment means for adjusting the axial displacement.

4. The system according to claim 3, wherein the adjustment means comprises a thread connection defining a thread path essentially coaxial to the mandrel.

5. The system according to claim 1, wherein the spacer means comprises resilient means for providing axial resilience to the tubular ends when coupled.

6. The system according to claim 5, wherein the resilient means in at least one of the transmission units has a lower stiffness than the resilient means in another one of the transmission units.

7. The system according to claim 1, further comprising first locking means for establishing a releasable axial coupling between the first fixture element and an inner surface of the tubular end.

8. The system according to claim 1, further comprising second locking means for axially releasably locking the second fixture element on an outer surface of the mandrel.

9. The system according to claim 8, wherein the second locking means is controllably lockable and releasable.

10. The system according to claim 8, wherein the second locking means is controllably lockable and releasable by relative rotation of the second fixture element and the mandrel about the alignment axis.

11. The system according to claim 9, wherein the second locking means is comprised of at least one set of cooperating locking rim segments, one locking rim segment being provided on a locking portion of the mandrel and one locking rim segment being provided on the second fixture element.

12. The system according to claim 1, wherein the spacer means comprises a bearing element within a bearing race supporting the bearing element in a plane perpendicular to the alignment axis, whereby the first fixture element is rotatable with respect to the second fixture element about the alignment axis.

13. The system according to claim 1, wherein the tubular end is a first tubular end and the mandrel is a second tubular end.

14. A system for axially coupling a tubular end with a mandrel, the system comprising a tubular end, a mandrel inserted into the tubular end, the mandrel in axial alignment with the tubular end thereby forming an annular space between the tubular end and the mandrel, and a connecting assembly in the annular space, the connecting assembly comprises two or more transmission units, each transmission unit being arranged for axially coupling the tubular end with the mandrel, wherein each transmission unit is comprised of a first fixture element, a second fixture element, and spacer means for maintaining an axial displacement between the first fixture element and the second fixture element, whereby the first fixture element is axially connectable to an inner surface of the tubular end and the second fixture element is axially connectable with the mandrel, wherein the spacer means comprises adjustment means for adjusting the axial displacement which adjustment means comprises a thread connection defining a thread path essentially coaxial to the mandrel.

15. The system according to claim 14, wherein the spacer means comprises resilient means for providing axial resilience to the tubular ends when coupled.

16. The system according to claim 15, wherein the resilient means in at least one of the transmission units has a lower stiffness than the resilient means in another one of the transmission units.

17. The system according to claim 14, further comprising first locking means for establishing a releasable axial coupling between the first fixture element and an inner surface of the tubular end.

18. The system according to claim 14, further comprising second locking means for axially releasably locking the second fixture element on an outer surface of the mandrel.

19. The system according to claim 18, wherein the second locking means is controllably lockable and releasable.

20. The system according to claim 18, wherein the second locking means is controllably lockable and releasable by relative rotation of the second fixture element and the mandrel about the alignment axis.

21. The system according to claim 19, wherein the second locking means is comprised of at least one set of cooperating locking rim segments, one locking rim segment being provided on a locking portion of the mandrel and one locking rim segment being provided on the second fixture element.

22. The system according to claim 14, wherein the spacer means comprises a bearing element within a bearing race supporting the bearing element in a plane perpendicular to the alignment axis, whereby the first fixture element is rotatable with respect to the second fixture element about the alignment axis.

23. A system for axially coupling a tubular end with a mandrel, the system comprising a tubular end, a mandrel inserted into the tubular end, the mandrel in axial alignment with the tubular end thereby forming an annular space between the tubular end and the mandrel, and a connecting assembly in the annular space, the connecting assembly comprises two or more transmission units, each transmission unit being arranged for axially coupling the tubular end with the mandrel, wherein each transmission unit is comprised of a first fixture element, a second fixture element, and spacer means for maintaining an axial displacement between the first fixture element and the second fixture element, whereby the first fixture element is axially connectable to an inner surface of the tubular end and the second fixture element is axially connectable with the mandrel, further comprising second locking means for axially releasably locking the second fixture element on an outer surface of the mandrel, wherein the second locking means is controllably lockable and releasable, and wherein the second locking means is comprised of at least one set of cooperating locking rim segments, one locking rim segment being provided on a locking portion of the mandrel and one locking rim segment being provided on the second fixture element.

24. The system according to claim 23, wherein the spacer means comprises resilient means for providing axial resilience to the tubular ends when coupled.

25. The system according to claim 24, wherein the resilient means in at least one of the transmission units has a lower stiffness than the resilient means in another one of the transmission units.

26. The system according to claim 23, wherein the second locking means is controllably lockable and releasable by relative rotation of the second fixture element and the mandrel about the alignment axis.

27. The system according to claim 23, further comprising first locking means for establishing a releasable axial coupling between the first fixture element and an inner surface of the tubular end.

28. The system according to claim 23, wherein the spacer means comprises a bearing element within a bearing race supporting the bearing element in a plane perpendicular to the alignment axis, whereby the first fixture element is rotatable with respect to the second fixture element about the alignment axis.

* * * * *